US011230455B2

(12) United States Patent
Michel et al.

(10) Patent No.: US 11,230,455 B2
(45) Date of Patent: Jan. 25, 2022

(54) METHOD FOR CONFIGURING SECURITY RELATED CONFIGURATION PARAMETERS IN A PASSENGER TRANSPORT INSTALLATION

(71) Applicant: Inventio AG, Hergiswil (CH)

(72) Inventors: David Michel, Rotkreuz (CH); Martin Pfister, Lucerne (CH); Michael Geisshüsler, Lucerne (CH); Simon Zingg, Kloten (CH); Eric Birrer, Buchrain (CH)

(73) Assignee: INVENTIO AG, Hergiswil (CH)

( * ) Notice: Subject to any disclaimer, the term of this patent is extended or adjusted under 35 U.S.C. 154(b) by 191 days.

(21) Appl. No.: 16/618,446

(22) PCT Filed: Jul. 9, 2018

(86) PCT No.: PCT/EP2018/068471
§ 371 (c)(1),
(2) Date: Dec. 2, 2019

(87) PCT Pub. No.: WO2019/011828
PCT Pub. Date: Jan. 17, 2019

(65) Prior Publication Data

US 2020/0130986 A1 Apr. 30, 2020

(30) Foreign Application Priority Data

Jul. 14, 2017 (EP) ..... 17181502

(51) Int. Cl.
*B66B 1/34* (2006.01)

(52) U.S. Cl.
CPC ..... *B66B 1/3407* (2013.01); *B66B 1/3492* (2013.01)

(58) Field of Classification Search
CPC ..... G06N 5/047; G06K 7/10732; G06K 7/10594; G06K 7/1413; G06K 7/10564;
(Continued)

(56) References Cited

U.S. PATENT DOCUMENTS 3,963,098 A 6/1976 Lewis et al.
4,798,267 A * 1/1989 Foster ..... B66B 1/3492 187/389
(Continued)

FOREIGN PATENT DOCUMENTS

CN 101108708 A 1/2008
CN 106115401 A 11/2016
(Continued)

*Primary Examiner* — Marlon T Fletcher
(74) *Attorney, Agent, or Firm* — William J. Clemens; Shumaker, Loop & Kendrick, LLP

(57) ABSTRACT

A method for configuring security related configuration parameters is used in a passenger transport installation that includes at least one sensor exchanging sensor signals with a control. The sensor detects operating parameters within the passenger transport installation and emits corresponding sensor signals. The control controls security related functions of the passenger transport installation taking into account the sensor signals and the configuration parameters. The method includes: comparing the sensor signals with a predefined key signal pattern; operating the control temporarily in a configuration mode exclusively if the compared sensor signals correspond to the key signal pattern; and configuring the security related configuration parameters during the configuration mode. An installation-specific sensor (e.g. optical sensor or magnetic field sensor) functions as an interface to put the control into configuration mode in a targeted manner, e.g. by a test piece with a barcode maintained in the field of view of the optical sensor.

16 Claims, 1 Drawing Sheet

(58) Field of Classification Search
CPC ..... G06K 9/4604; G06K 19/06028; G06K 19/0712; G06K 7/1404; B66B 1/3415; B66B 3/00; B66B 1/24; B66B 1/3492; B66B 1/285; B66B 1/30; B66B 5/0018; B66B 5/0025; B66B 7/1223; B66B 5/0031; B66B 13/26; B66B 5/0037; B66B 1/3407; B66B 1/32; B66B 5/0006
See application file for complete search history.

(56) References Cited

U.S. PATENT DOCUMENTS 6,082,498 A 7/2000 Coste et al.
2002/0104716 A1* 8/2002 Zaharia ..... B66B 1/3492 187/394
2003/0080851 A1 5/2003 Gerstenkorn
2006/0032711 A1* 2/2006 Marchesi ..... B66B 1/3492 187/394
2006/0124399 A1* 6/2006 Kugiya ..... B66B 5/06 187/295
2011/0108368 A1* 5/2011 Yamamoto ..... B66B 11/024 187/293
2012/0292136 A1* 11/2012 Washio ..... B66B 5/0031 187/393
2013/0001023 A1* 1/2013 Leutenegger ..... B66B 3/023 187/394
2013/0015022 A1* 1/2013 Sonnenmoser ..... B66B 7/064 187/394
2013/0284544 A1 10/2013 De Coi et al.
2015/0059195 A1* 3/2015 De Coi ..... B66B 7/064 33/760
2015/0060210 A1* 3/2015 De Coi ..... G01D 5/347 187/277
2016/0311648 A1* 10/2016 Vaarala ..... B66B 19/00
2016/0311649 A1* 10/2016 Puranen ..... B66B 1/3492
2018/0201477 A1* 7/2018 Shibata ..... B66B 5/06
2018/0312371 A1* 11/2018 Wuthrich ..... B66B 1/3492
2020/0130986 A1* 4/2020 Michel ..... B66B 1/3407
2020/0198929 A1* 6/2020 Michel ..... G01D 5/142
2020/0198933 A1* 6/2020 Kusserow ..... B66B 13/08
2021/0139274 A1* 5/2021 Tschuppert ..... B66B 27/00

FOREIGN PATENT DOCUMENTS

EP 1412274 B1 3/2011
EP 3231753 A1 10/2017
JP S6417783 A 1/1989
WO 03011733 A1 2/2003
WO 2011076533 A1 6/2011
WO 2016096826 A1 6/2016
WO 2016202644 A1 12/2016

* cited by examiner

METHOD FOR CONFIGURING SECURITY RELATED CONFIGURATION PARAMETERS IN A PASSENGER TRANSPORT INSTALLATION

FIELD

The present application relates to passenger transport installations such as elevators, escalators or moving walkways. In particular, the application relates to a method for configuring security related configuration parameters in a passenger transport installation and a passenger transport installation designed to perform such a method.

BACKGROUND

Passenger transport installations are generally installed in buildings and used to transport persons within the buildings. In this context, the passenger transport installation must meet high safety requirements. To do this, the passenger transport installation is usually equipped with a control that can be used to control security related functions of the passenger transport installation. Such security related functions may be, for example, drive systems, braking systems, door systems, alarm systems, etc. of the passenger transport installation. Furthermore, the passenger transport installation is usually equipped with various sensors, which are designed to detect current operating parameters within the passenger transport installation. Such operating parameters may be, for example, current states, positions or speeds of components of the passenger transport installation. Operating parameters measured or detected by the sensors can be forwarded to the control in the form of sensor signals, so that the control can control the security related functions of the passenger transport installation taking into account the detected operating parameters as well as the predetermined configuration parameters.

A system for determining the position of an elevator car in an elevator shaft of an elevator installation is described in EP 3231753 A1. A tape measure with an optical encoder for measuring length is arranged vertically in the elevator shaft for this purpose. A marking element is arranged on the tape measure. A sensor device is attached to the elevator car, which comprises a light source and a sensor which form a detection field for detecting the tape measure. The elevator installation comprises an evaluation device for decoding the codes in the detection field and a control device for controlling the elevator installation as a function of the coding and/or the position of at least one marking element on the tape measure. After installing the elevator installation, the control device is set to learning mode and the elevator car is moved in the elevator shaft so that the marking elements can be detected. From the position or the coding of the marking elements, the control derives specifications for operating the elevator installation, such as the maximum speed, and stores them for normal operation of the elevator installation.

US 2003/080851 A1 describes an elevator installation with an access control system. To configure the access control system, a so-called master identification code can be entered via a man-machine interface otherwise used by passengers of the elevator installation, for example, for entering a destination floor, and thus a configuration mode can be activated. The entry can be made, for example, by means of an identification transmitter in the form of a transponder with a transponder antenna and encoder electronics. In the configuration mode, settings of the access control system can be changed.

In the following, passenger transport installations and their operation are explained using the example of an elevator. Equivalents can, however, also be easily applied to escalators, moving walkways and the like.

In an elevator, a control is used to ensure the safety of the elevator by monitoring elevator-typical operating parameters and correspondingly controlling elevator-typical security related functions. Security related functions are, for example, limiting the maximum travel speed of an elevator car or the maximum permissible acceleration, ensuring that all doors are closed within the elevator installation before the elevator car is moved, etc.

In order to always be able to control the security related functions according to the situation, the elevator installation is equipped with various sensors, by means of which current operating parameters within the elevator installation, such as the current speed of the elevator car, the acceleration currently acting on the elevator car, currently prevailing closing states of the doors within the elevator installation, etc., can be measured or detected.

The security related functions are controlled by the control, taking into account both the operating parameters currently detected by the sensors as well as predetermined configuration parameters. Such configuration parameters are generally individually tailored to a particular passenger transport installation or a particular type of passenger transport installation and indicate, for example, how the control should act when certain predefined operating conditions are detected within the passenger transport installation based on the operating parameters detected by the sensors. For example, the configuration parameters can specify the maximum speed an elevator car must never exceed, the speed at which braking processes must be initiated, and/or the way in which such braking processes should be controlled.

Conventionally, type-specific configuration parameters are usually predefined for each type of elevator, and an identification number (ID) is then assigned to the elevator type. In other words, configuration parameters are already defined during the development of an elevator type, and these configuration parameters are then predefined for each individual elevator, i.e., for example, permanently programmed into an elevator control system.

However, it has been recognized that it may be advantageous or necessary to configure individual elevators of one and the same elevator type differently, depending on how and/or where the individual elevator is to be used. For example, security related configuration parameters, such as the maximum speed the elevator car must not exceed, can be selected depending on how the elevator is to be used and/or how long the actual travel path of an individual elevator is. Furthermore, legal requirements, for example, which an elevator must meet may differ regionally or nationally, so that appropriate security related configuration parameters must be suitably specified in order to take these local legal regulations into account.

Accordingly, it may be desirable to be able to individually configure each individual elevator of an elevator type, i.e. to be able to specify security related configuration parameters individually. This can be done, for example, as part of a commissioning process, in which an already prefabricated or largely completed elevator is configured individually for its intended use and/or its place of use. For example, all elevators of an elevator type can be assembled centrally in a manufacturing plant and then delivered to different regions of the world. In each region, the elevators can then be individually configured and commissioned according to local requirements and statutory regulations. This can be done in particular before the respective elevator is actually installed at its place of use.

However, providing the option to individually configure elevators with regard to their security related configuration parameters can also entail risks. In particular, there may be a risk that security related configuration parameters may be inadvertently or intentionally misconfigured, thereby creating dangers during operation of the elevator and/or not operating the elevator at least in accordance with local regulations.

There may therefore be a need for a method for configuring security related configuration parameters in a passenger transport installation, by means of which, on the one hand, passenger transport installations can be configured individually, and, on the other, the aforementioned risks of incorrect configuration can be minimized as far as possible. There may also be a need for a passenger transport installation designed to perform such a method or to be configured using such a method.

SUMMARY

A need of this kind can be satisfied by the subject matter according to any of the embodiments specified in the following description.

According to a first aspect of the invention, a method for configuring security related configuration parameters in a passenger transport installation is proposed. The passenger transport installation comprises a control and at least one sensor, which is connected to the control for exchanging sensor signals. The sensor is designed to detect operating parameters within the passenger transport installation and to emit corresponding sensor signals. In this context, operating parameters are to be understood as current properties of components of the passenger transport installation or information possibly encoded on information carriers. Operating parameters are to be distinguished from inputs of a passenger or a service technician which are entered via a man-machine interface of the passenger transport installation. Operating parameters in the context of the invention can be, for example, current states, positions, rotational speeds, rotational accelerations, speeds or accelerations of components of the passenger transport installation. In this context, for example, a state of a switch may be whether it is open or closed. A state can, for example, also be understood as the temperature of a component. Encoded information contained on an information carrier may, for example, be encoded to represent a position of the elevator car on a magnetic tape arranged in the elevator shaft. The operating parameters are detected within the passenger transport installation. In the case of an elevator, this means in particular that the operating parameters are detected within an elevator shaft or any existing engine room, i.e., in areas that are not entered during normal operation of the passenger transport installation. In the case of an escalator or moving walkway, this is to be understood in particular as meaning that the operating parameters are detected in an interior space of the escalator or moving walkway. The interior of an escalator or a moving walkway is enclosed by cladding and covers.

The control is configured to control security related functions of the passenger transport installation, taking into account sensor signals emitted by the sensor and taking into account the configuration parameters. The method comprises at least the following steps, preferably in the order indicated:

comparing sensor signals emitted by the sensor with a predefined key signal pattern;

operating the control temporarily in a configuration mode exclusively if the compared sensor signals correspond to the key signal pattern;

configuring the security related configuration parameters during the configuration mode, in particular exclusively during the configuration mode.

According to a second aspect of the invention, a passenger transport installation is described which is designed as indicated in relation to the first aspect of the invention and adapted to configure the configuration parameters by a method according to an embodiment of the first aspect of the invention.

Possible features and advantages of embodiments of the invention may be considered, inter alia and without limiting the invention, to be dependent upon the concepts and findings described below.

As already indicated in the introduction, it has been recognized that, although on the one hand it may be advantageous to be able to individually configure passenger transport installations with regard to their security related configuration parameters, on the other hand a risk of incorrect configuration may arise.

In particular, it was envisaged to configure configuration parameters in a control of a passenger transport installation via a conventional man-machine interface. For example, a keyboard, a touch-sensitive screen, or the like could be provided and connected to the control, by way of which configuration parameters could be input by an installer or other qualified personnel. Such a man-machine interface could, for example, be individually wired to the control or communicate with it via a bus system, for example a secure CAN bus. However, such an approach creates a need for additional hardware components for the man-machine interface and/or for additional effort to connect the man-machine interface to the control. There is also a risk that the man-machine interface could, for example, be handled incorrectly and that inadvertent, or even manipulated, incorrect configuration parameters could thus be entered into the control.

According to the approach presented herein, a separate human-machine interface is not required. Instead, sensors usually already provided in the passenger transport installation are to be used to configure a control that communicates with the sensors in accordance with predetermined security related configuration parameters.

For this purpose, sensor signals emitted by the sensors are intended to be examined continuously or at suitable time intervals to determine whether they correspond to a predetermined so-called key signal pattern. If this is the case, the control takes this to mean that it should temporarily switch to a configuration mode in which the security related configuration parameters to be taken into account can be changed. In other words, in the event that the key signal pattern is detected in the sensor signals emitted by the sensors, the configuration mode is enabled by the control, so that the control can be reconfigured. As soon as this configuration mode is enabled, the security related configuration parameters are configured in the control. Especially when the control is in the configuration mode, no operation of the passenger transport installation is possible. For example, in the case of an elevator, the elevator car may not be moved for safety reasons.

This approach may be based on the consideration that the sensors in the passenger transport installation originally intended for other purposes, namely for monitoring operating parameters within the passenger transport installation, can be used to take appropriate measures to selectively generate specific sensor signals through these sensors and emit them to the control, whereby these signals may correspond to the predetermined key signal pattern. As soon as this is detected by the control, it temporarily goes into its configuration mode so that new or changed configuration parameters can then be entered. In other words, at least one of the sensors provided in the passenger transport installation can be selectively stimulated in such a way that it emits sensor signals corresponding to the key signal pattern to the control and thus switches the control to its configuration mode. Receiving a sensor signal or a sensor signal sequence which corresponds to the key signal pattern can thus be used in a manner similar to a key for temporarily putting the control into its configuration mode, thus being able to configure or reconfigure it.

According to one embodiment, the sensor signals corresponding to the key signal pattern differ from all sensor signals to be emitted by the sensor during normal operation of the passenger transport installation.

In other words, the key signal pattern may be a unique sensor signal or a unique sequence of sensor signals such as are generally, i.e., due to the sensor's structural and functional properties, able to be generated by the sensor in question. The sensor signals may be analog signals or digital signals. In this context, the key signal pattern should preferably be a sensor signal or a sequence of sensor signals such as are not detected by the sensor during normal operation of the transport installation, i.e., while the sensor is monitoring the operating parameters within the passenger transport installation according to the sensor's actual purpose.

In other words, sensor signals corresponding to the key signal pattern may correspond to operating parameters that do not normally occur in the passenger transport installation. Such extraordinary sensor signals can therefore be distinguished by the control from the normal signals to be expected by the sensor during operation, and thus, similar to a kind of "code", be used as an indicator that the control should be prompted to perform actions deviating from its normal operation and, for example, switch to its configuration mode.

As soon as the control has entered its configuration mode, a configuration process can be started in which security related configuration parameters are set or modified within the control. In principle, the configuration parameters can be assigned to the control in various ways. For example, it is conceivable to be able to enter configuration parameters via a man-machine interface as soon as the control has been "enabled" in its configuration mode by receiving the sensor signals corresponding to the key signal pattern. Other ways of transmitting the configuration parameters to be set are also conceivable.

According to one embodiment of the invention, it can be regarded as particularly preferable for the security related configuration parameters to be configured based on sensor signals emitted by the sensor during the configuration mode.

In other words, for example, the sensor that was used to transmit the sensor signals corresponding to the key signal pattern to the control can then also be used to transmit sensor signals to the control which correspond to the configuration parameters to be set. These sensor signals can be referred to as a configuration signal pattern analogous to the term "key signal pattern". The sensor signals can in this case represent, for example, a type of "code" which codifies the configuration parameters to be set.

Similar to the sensor signals corresponding to the key signal pattern, it may be advantageous to use or prompt special sensor signals representing configuration parameters which are not emitted by the sensor during normal operation. In this way, confusion with operating parameters normally monitored by the sensor or with corresponding output sensor signals can be avoided. However, such a selection of sensor signals representing the configuration parameters is not mandatory. It could also be envisaged that the control, during its configuration mode, interprets sensor signals that would normally represent operating parameters of the passenger transport installation, not as such but as sensor signals representing the configuration parameters. In this case, the sensor signals transmitted by the sensor would normally be interpreted as sensor signals representing the actual operating parameters only after the control has again come out of configuration mode.

Different types of sensors can be used as sensors whose sensor signals can be used to set the control in configuration mode. It may in particular be preferable to use absolute value sensors to do this, for example so-called absolute value encoders, i.e. sensors that generate their sensor signals based on absolute measurements, for example, rather than on a relative comparison with a reference value.

According to one embodiment, the sensor is a magnetic field sensor. The magnetic field sensor may then be prompted to emit a signal pattern corresponding to the key signal pattern by a suitably statically premagnetized test piece being brought close to the magnetic field sensor.

In other words, the sensor can be designed to detect magnetic fields with regard to their strength and/or their direction. Such magnetic field sensors are used in passenger transport installations, for example, to be able to determine positions and/or speeds of moving components relative to stationary components. For example, the movable elevator car in an elevator can be equipped with a magnetic field sensor. A stationary magnetic tape can be provided in the elevator shaft. The magnetic tape may have a local magnetization or magnetization sequence depending on the location within the elevator shaft. This can then be read by the magnetic field sensor to determine the current position and/or speed of the elevator car.

Such a magnetic field sensor can be selectively manipulated in such a way as to emit a signal pattern corresponding to the key signal pattern, i.e., a special sensor signal or a special sensor signal sequence. For this purpose, a suitably statically premagnetized test piece can be attached to the magnetic field sensor, so that the magnetic field sensor can detect the premagnetization thereof and emit sensor signals corresponding to this premagnetization.

The premagnetized test piece may be a kind of magnetic tape, for example. The magnetic tape may be locally differently premagnetized along its direction of extension. As a result, a kind of magnetic "code" can be statically impressed on the magnetic tape, which can be read by the magnetic field sensor, and which prompts the magnetic field sensor to emit sensor signals corresponding to the key signal pattern. The magnetic tape may have the same or similar physical properties as magnetic tapes used in elevator shafts to determine position or speed. A suitable selection of physical parameters such as the geometric dimensions of the magnetic tape, the type, direction and strength of the magnetic fields realized in the tape, etc., can at least provide a certain degree of protection against manipulation, counterfeiting or unauthorized copies being made. Magnetic tape is also inexpensive to produce, magnetizable as well as light and thus easily transportable.

The premagnetized test piece or, in this specific case, the magnetic tape can thus serve as a kind of key, which can be held on the magnetic field sensor or moved past it to prompt the magnetic field sensor to emit the sensor signals corresponding to the key signal pattern, thereby switching the control of the passenger transport installation into its configuration mode.

A corresponding test piece or magnetic tape can previously be co-developed, for example, during development or production of an elevator type, and the magnetic "code" stored on the test piece/magnetic tape can be compared with the key signal pattern expected by the control of the passenger transport installation. Such a test piece/magnetic tape can then be duplicated if necessary and then made available, for example, to the respective bodies responsible for commissioning this type of elevator.

For example, a commissioning authority, which is intended to configure all elevators being delivered within a predefined region, can be supplied with a corresponding test piece/magnetic tape so that the commissioning authority can thus use the associated sensor to put the control into its configuration mode in order to then configure it to comply with regional regulations, for example.

Since the statically premagnetized test piece/magnetic tape can be manufactured as dedicated hardware by, for example, a manufacturer of the passenger transport installation and then made available to the respective commissioning authorities, the risk of unauthorized persons configuring passenger transport installation can be minimized. In addition, handling of the test piece/magnetic tape is also very simple, so incorrect configuration of the control of the passenger transport installation due to improper handling is unlikely.

According to an alternative embodiment, the sensor is again designed as a magnetic field sensor. In this case, the magnetic field sensor is prompted to emit a signal pattern corresponding to the key signal pattern by dynamically generating a suitably predefined magnetic field close to the magnetic field sensor by means of a magnetic field generator.

In other words, like the above-described embodiment, the sensor used to initiate the configuration mode may be a magnetic field sensor. Instead of a statically premagnetized test piece/magnetic tape, however, a magnetic field generator can be used in this case to prompt the output of the sensor signals corresponding to the key signal pattern in the magnetic field sensor.

The magnetic field generator can generate magnetic fields dynamically. The magnetic field generator can be designed to generate temporally varying magnetic fields of different strength and/or alignment. For example, the magnetic field generator can have one or more electrically excitable coils, which can generate a sequence of magnetic fields when different currents are applied. In principle, such a magnetic field generator can generate any desired sequence of magnetic fields and thereby emulate, for example, different types of key signal patterns.

A commissioning authority can, for example, maintain such a magnetic field generator and additionally receive, for example, a program code which instructs the magnetic field generator to generate a sequence of magnetic fields which corresponds to a specific predetermined key signal pattern. In contrast to the embodiment described above, in this case the physical test pieces/magnetic tapes corresponding to each type of elevator do not therefore need to be held by the commissioning authorities and, accordingly and can initially be sent to the respective commissioning authorities by a manufacturer of the passenger transport installation, for example. Instead, each commissioning authority can be provided with a magnetic field generator one time. By electronic transmission of the program code, for example, this magnetic field generator can then be enabled to generate the necessary key signal pattern in an individual passenger transport installation in order to then be able to configure it.

According to one embodiment, when the control has been put in its configuration mode as described above, during the configuration mode the magnetic field sensor is prompted to emit signals indicative of desired configuration parameters by a suitably statically premagnetized test piece being brought close to the magnetic field sensor.

In other words, the magnetic field sensor is not merely used to put the control in its configuration mode by detecting the key signal pattern, but also to then perform the actual configuration, i.e. to enter the desired configuration parameters into the control.

Also, for this purpose, a statically premagnetized test piece can be used, for example in the form of a magnetic tape. A locally varying premagnetization which represents the desired codified configuration parameters can be implemented on the test piece. The configuration parameters may differ, for example, depending on where, how and/or for what purpose an individual elevator is to be used. For each situation, for example, a special premagnetized test piece can in this case be provided, on which the corresponding configuration parameters are impressed in a magnetically codified manner.

If necessary, the premagnetized test piece to be used to generate the key signal pattern, and the premagnetized test piece, by means of which the desired configuration parameters are to be specified, can be designed as a common, i.e. integral, premagnetized test piece.

According to an alternative embodiment, during the configuration mode the magnetic field sensor can be prompted to emit signals indicating desired configuration parameters by dynamically generating a suitably predefined magnetic field close to the magnetic field sensor by means of a magnetic field generator.

Similar to the embodiment explained above, the magnetic field sensor can in this case be used to both enable the configuration mode and to then dynamically generate magnetic fields using a magnetic field generator in such a way that suitable sensor signals are transmitted to the control via the magnetic field sensor in order to communicate the desired configuration parameters to the control. The magnetic field generator can in turn be designed to generate magnetic fields of varying strength and/or alignment.

Since the magnetic field generator is capable of generating different magnetic fields or different magnetic field sequences, the magnetic field generator can be used, for example, to generate both magnetic fields which generate the sensor signals corresponding to the key signal pattern in the magnetic field sensor as well as magnetic fields that generate the sensor signals corresponding to the desired configuration parameters in the magnetic field sensor. In some cases, a type of program code must be made available to the magnetic field generator in order to program it to generate the desired magnetic fields.

According to an alternative embodiment, the sensor is an optical sensor. In this case, the optical sensor can be prompted to emit a signal pattern corresponding to the key signal pattern when a test piece with a suitable optically readable static pattern is brought into the field of view of the optical sensor.

In other words, the sensor can be designed to be able to detect optically detectable physical properties such as light intensities, colors, etc., and to be able to resolve these spatially and/or temporally if necessary. In particular, the sensor may be designed as a light sensor, for example in the form of a photodiode, a laser scanner, a camera, or something of a similar manner.

Optical sensors can be used in passenger transport installations similar to or complementary to the magnetic field sensors described above to measure the current position or speed of a movable component relative to static components within the passenger transport installation by attaching the optical sensor to the movable component, such as an elevator car, and providing optically readable markings on the static components, such as an elevator shaft.

In such an optical sensor, sensor signals can be generated by, for example, specifying a specific light pattern for the sensor. The light pattern may include, for example, a temporal sequence of light intensities and/or colors. In this case, the light pattern can represent a type of "code" which prompts the optical sensor to emit the sensor signals corresponding to the key signal pattern. The light pattern may be illuminated by itself or by an external light source. For example, the light pattern may be a barcode, a QR code, or the like.

The light pattern may be formed, for example, on a test piece. In this case, the light pattern can be statically impressed on the test piece. The test piece may be, for example, a simple substrate, for example in the form of paper, film, etc., on the surface of which optically reflecting or absorbing areas of varying strength are formed.

The test piece designed in this way can then be brought into the field of view of the optical sensor or be moved through it. In this way, for example, a sensor signal sequence corresponding to the key signal pattern can be generated in the optical sensor.

Similar to the statically premagnetized test pieces described above, the described light-patterned test piece can thus be used to put its control into the configuration mode via the optical sensor of the passenger transport installation. The test piece can in turn be made available, for example, to a commissioning authority. The test piece can be provided in a suitable form to ensure its ease of handling and/or to largely avoid misuse, manipulation or the like.

According to an alternative embodiment, the sensor is again an optical sensor but, in this case, the optical sensor is prompted to emit a signal pattern corresponding to the key signal pattern by dynamically generating a suitably predefined, optically readable pattern in the field of view of the optical sensor by means of a controllable light source.

Instead of a test piece with an optically readable pattern statically defined on it, a controllable light source can thus be used to dynamically generate an optically recognizable pattern. The pattern can be, for example, a sequence of different light intensities, colors, etc., such as can be generated in a controlled manner by the light source. A spatial distribution of the light emitted by the light source can also be modified in a controlled manner, i.e., the light source can generate light patterns that vary both temporally and spatially. The light source may be a largely point-like, i.e., zero-dimensional light source, i.e. a simple lamp, an LED, a laser or the like, for example. Alternatively, the light source can also be designed as a one-dimensional or two-dimensional light source, for example in the form of a light band, a screen or the like. The light source may have a light source control, by means of which the light intensity, color, spatial distribution or other optical properties of the light emitted by the light source can be controlled.

Similar to the case of the magnetic field generator described above, the controllable light source can thus in principle be used to prompt any desired control signals in the optical sensor of the passenger transport installation. By providing the controllable light source, for example, with a special program code, the light source can be prompted to generate light in a dynamic pattern such that the sensor signals corresponding to the key signal pattern are generated in the optical sensor.

A corresponding light source can be made available, for example, to a commissioning authority and the special program code can then be transmitted to the commissioning authority, so that the commissioning authority can activate the configuration mode in the control of a passenger transport installation.

According to one embodiment, the optical sensor is not only used to activate the configuration mode in the control of the passenger transport installation, but also prompts the optical sensor during the configuration mode to emit signals indicating desired configuration parameters. This can be done in particular by bringing a test piece with a suitable, optically readable, static pattern into the field of view of the optical sensor.

The optically readable test piece may be similar or equal to the one with which the sensor signals corresponding to the key signal pattern were previously prompted and differ only with respect to the optically readable pattern stored on it. Optionally, a common test piece may contain both the pattern for the generation of the key signal pattern and for the generation of the signal pattern representing the desired configuration parameters.

The handling described above in relation to the statically premagnetized test piece and the advantages thus achievable during the configuration or commissioning of passenger transport installations can also be analogously applied to the optically readable test piece.

According to an alternative embodiment, during the configuration mode, the optical sensor can be prompted to emit signals indicating desired configuration parameters by dynamically generating a suitably predefined, optically readable pattern in the field of view of the optical sensor by means of a controllable light source.

The controllable light source may be the same light source or a similarly constructed light source as that used to generate the optically readable pattern by which the sensor signals corresponding to the key signal pattern are prompted in the optical sensor.

The handling described above in relation to the magnetic field generator and the advantages thus achievable during the configuration or commissioning of passenger transport installations can also be analogously applied to the embodiment with the controllable light source.

According to one embodiment, the method proposed herein is carried out exclusively within a predefined limited period of time following a system start of the passenger transport installation.

In other words, it may be advantageous not to allow the method for configuring the configuration parameters in a passenger transport installation to be performed at any time during the operation of the passenger transport installation. Instead, it may be advantageous to be able to perform said method only as part of a system start of the passenger transport installation or within a limited period of time after this system start. A system start can be interpreted as the initial entry into service of the passenger transport installation or as a restart, for example after a system failure. A period of time within which performance of the configuration method is still permitted after a system start can be limited, for example, to a few seconds or a few minutes, in particular, for example, less than 30 minutes or preferably less than 3 minutes.

The fact that it is allowed only at or shortly after the system start to switch the control of the passenger transport installation to its configuration mode by means of the method described can be used to further increase the security against an accidentally or deliberately faulty configuration.

In particular, it can be avoided that, for example, during operation of the passenger transport installation, errors, for example in one of the sensors or in a transmission of sensor signals, can lead to sensor signals being incorrectly generated or transmitted to the control, which sensor signals correspond to the key signal pattern and thereby switch the control to configuration mode without good reason.

It should be noted that some of the possible features and advantages of the invention are described herein with reference to different embodiments of the configuration method in one respect and with reference to the personal transport system designed to carry it out in another respect. A person skilled in the art will recognize that these features can be combined, adapted or replaced as appropriate in order to obtain further embodiments of the invention.

Embodiments of the invention are described below with reference to the accompanying drawings, with neither the drawings nor the description being intended to be interpreted as limiting the invention.

The drawings are merely schematic and not to scale. Like reference signs refer to like or analogous features in the different drawings.

DETAILED DESCRIPTION

Figure 1:
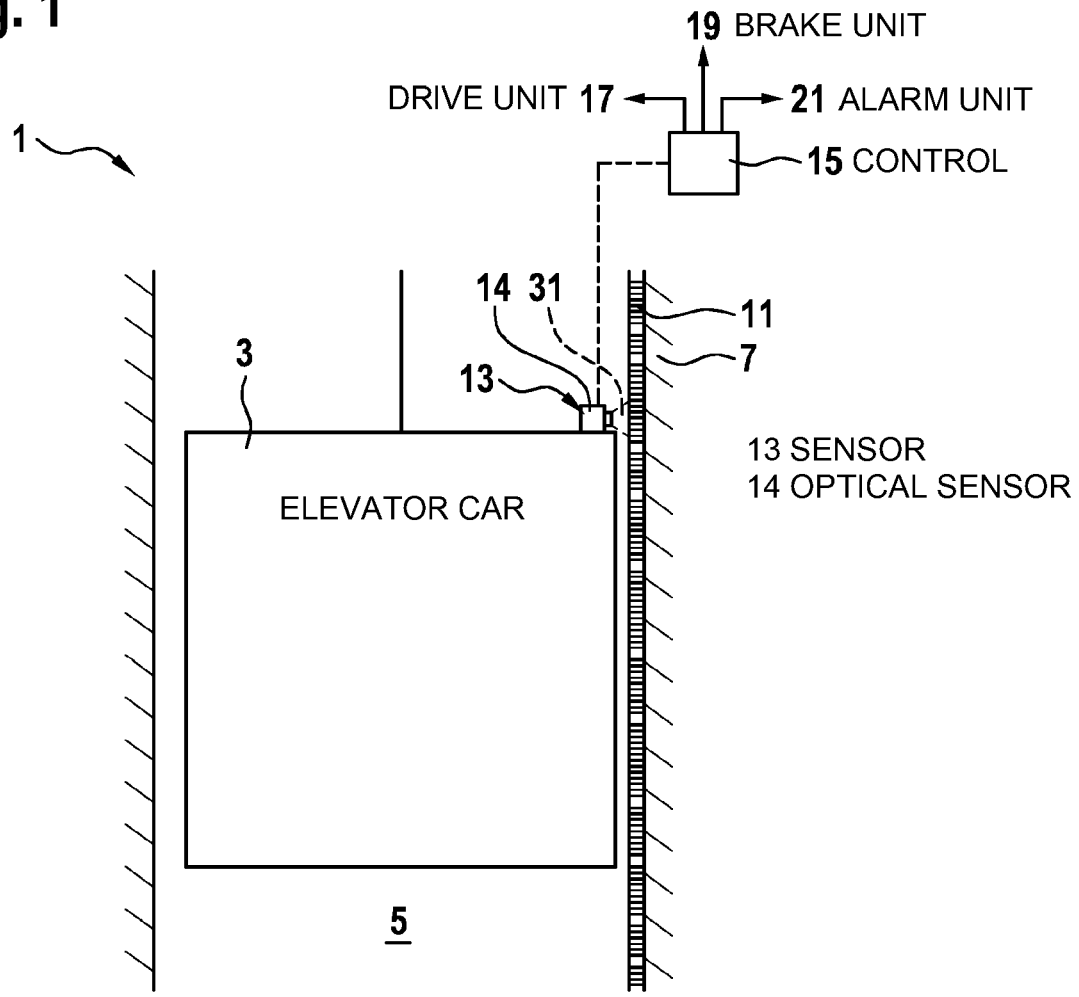
FIG. 1 shows a passenger transport installation according to the invention in the form of an elevator.

FIG. 1 shows a passenger transport installation 1 in the form of an elevator according to an embodiment of the present invention. The elevator comprises a movable component in the form of an elevator car 3, which can be moved within an elevator shaft 5 relative to the elevator shaft and, for example, stationary components attached to the shaft walls 7 thereof.

The elevator comprises a control 15, which can be used to control the security related functions of the elevator. For example, the control 15 may detect safety-critical situations within the elevator, such as an elevator car 3 traveling too fast in the upward or downward direction, shaft doors not properly closed, a car door not properly closed, etc. The control 15 is connected to elevator components to be controlled by it, such as a drive unit 17, a brake unit 19, an alarm unit 21 (each not explicitly shown) and can control their operation according to the situation.

In order to be able to recognize the safety-critical situations, the control 15 is connected to various sensors 13, i.e., the control 15 can communicate with these sensors 13, for example in a wired or wireless manner. Each of these sensors 13 can be designed to measure or detect operating parameters within the passenger transport installation, which make it possible to draw conclusions about any present safety-critical situations.

By way of example only, a sensor 13 in the form of an optical sensor 14 is shown. This optical sensor 14 is arranged on the elevator car 3 and is moved together with it through the elevator shaft 5. The optical sensor 14 may be formed, for example, as a camera, laser scanner, photodiode or the like.

The field of view 31 of the optical sensor 14 is directed to visually recognizable markings 11, which are provided in the form of a band with a barcode tape on one of the shaft walls 7. By reading the markings 11, the control 15 can reach a conclusion about a current position and/or a current speed of the elevator car 3.

Since, for example, the maximum permissible speed of the elevator car 3 may not only depend on the type of elevator containing this elevator car 3 but also, for example, on regional or national legal regulations, it may be necessary to be able to configure such physical quantities, which are referred to herein as security related configuration parameters, individually for each elevator.

To make this possible, it can be provided that the security related configuration parameters in the control 15 are not permanently programmed, but can be modified. For this purpose, the control 15 can have, for example, a rewritable memory in which the configuration parameters can be saved.

However, it should be ensured that configuration parameters for the respective elevator are correctly entered and saved, since inadvertent or manipulated configuration parameters entered in error can result in security related hazards during operation of the elevator.

It is therefore proposed to use one of the sensors 13 already provided in the passenger transport installation 1 for monitoring the operating parameters in order to effect a suitable configuration of the control 15 by selectively prompting sensor signals.

For this purpose, measures can be carried out within the scope of a configuration process which prompt the sensor 13 to generate sensor signals in the form of a special pattern, whereby the pattern corresponds to a previously defined key signal pattern. The key signal pattern differs from signal patterns that are generated by the sensor 13 during normal operation.

As soon as the control 15, by comparing sensor signals emitted by the sensor 13 with the predefined key signal pattern, recognizes that the sensor 13 is not transmitting actual operating parameters but is instead receiving sensor signals corresponding to the key signal pattern, this is interpreted by the control 15 as an indication that the control 15 should be transferred to its configuration mode.

Once the control 15 is in this configuration mode, it is permitted that, for example, previously stored configuration parameters or random memory content may be replaced in a data memory intended for storing such configuration parameters. Subsequently, the desired configuration parameters are then transmitted to the control 15 and stored by it as security related configuration parameters to be observed in the future.

Figure 2:
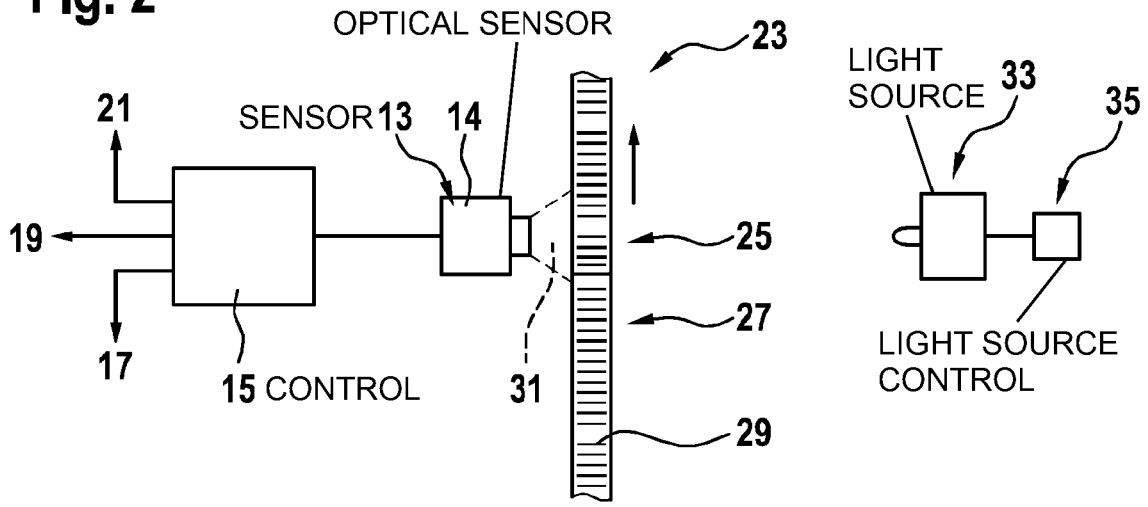
FIG. 2 shows components of a passenger transport installation according to the invention during the configuration of security related configuration parameters.

By way of example, it is shown in FIG. 2 how a test piece 23 in the optical sensor 14 first generates sensor signals which correspond to the key signal pattern, and then, after the control 15 has entered its configuration mode, generates sensor signals in the optical sensor 14 which correspond to the desired configuration parameters.

In the illustrated example, the test piece 23 is formed as a substrate strip with a barcode applied to its surface. This barcode is a static pattern which can be optically read by the optical sensor 14. The barcode can be divided into two areas 25, 27. In both areas, barcode patterns 29 encode certain information with bars of different widths and with different distances to each other. For example, a barcode indicated in the first area 25 may be an encoded representation of the key signal pattern. A barcode indicated in the second area 27 may be an encoded representation of the desired configuration parameters.

Instead of using the test piece 23, the optical sensor 14 can be enabled to use a dynamically controllable light source 33 to generate the sensor signals corresponding to the key signal pattern or the sensor signals corresponding to the desired configuration parameters. For example, the light source 33 can for this purpose be controlled by a light source control 35 to generate time-varying light patterns, which lead to the output of corresponding sensor signals in the optical sensor 14.

As an alternative to the design described with an optical sensor 14 and optically readable static or dynamic patterns on a test piece or generated by a controllable light source, designs in which other sensors 13 of the passenger transport installation are used as input interfaces to the control 15 are also conceivable.

For example, magnetic field sensors (not shown) can be used and sensor signals prompted in these by a suitably statically premagnetized test piece or a dynamically controllable magnetic field generator, said signals corresponding to the key signal pattern or the desired configuration parameters.

Finally, it should be noted that terms such as "comprising", "including", etc. do not preclude other elements or steps, and terms such as "a" or "an" do not preclude a plurality. Furthermore, it should be noted that features or steps that have been described with reference to one of the above embodiments may also be used in combination with other features or steps of other embodiments described above.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A method of configuring security related configuration parameters in a passenger transport installation, wherein the passenger transport installation includes a control and at least one sensor connected to the control for exchanging sensor signals, wherein the at least one sensor detects operating parameters within the passenger transport installation and emits corresponding ones of the sensor signals, wherein the control controls security related functions of the passenger transport installation taking into account the sensor signals emitted by the at least one sensor and taking into account the configuration parameters, the method comprising the steps of:

comparing the sensor signals emitted by the at least one sensor with a predefined key signal pattern;

operating the control temporarily in a configuration mode exclusively if the compared sensor signals correspond to the key signal pattern, wherein the sensor signals corresponding to the key signal pattern differ from all of the sensor signals emitted by the at least one sensor during a normal operation of the passenger transport installation; and configuring the security related configuration parameters during the configuration mode.

2. The method according to claim 1 including configuring the security related configuration parameters based on the sensor signals emitted by the at least sensor during the configuration mode.

3. The method according to claim 1 wherein the at least one sensor is a magnetic field sensor, and wherein the magnetic field sensor is prompted to emit a signal pattern corresponding to the key signal pattern by a suitably statically premagnetized test piece being brought close to the magnetic field sensor.

4. The method according to claim 3 wherein, during the configuration mode, the magnetic field sensor is prompted to emit signals indicating desired configuration parameters by a suitably statically pre-magnetized test piece being brought close to the magnetic field sensor.

5. The method according to claim 3 wherein the magnetic field sensor is prompted, during the configuration mode, to emit signals indicating desired configuration parameters by dynamically generating a suitably predefined magnetic field close to the magnetic field sensor by a magnetic field generator.

6. The method according to claim 1 wherein the at least one sensor is a magnetic field sensor, and wherein the magnetic field sensor is prompted to emit a signal pattern corresponding to the key signal pattern by dynamically generating a suitably predefined magnetic field close to the magnetic field sensor by a magnetic field generator.

7. The method according to claim 6 wherein, during the configuration mode, the magnetic field sensor is prompted to emit signals indicating desired configuration parameters by a suitably statically pre-magnetized test piece being brought close to the magnetic field sensor.

8. The method according to claim 6 wherein the magnetic field sensor is prompted, during the configuration mode, to emit signals indicating desired configuration parameters by dynamically generating a suitably predefined magnetic field close to the magnetic field sensor by a magnetic field generator.

9. The method according to claim 1 wherein the at least one sensor is an optical sensor, and wherein the optical sensor is prompted to emit a signal pattern corresponding to the key signal pattern by a test piece with an optically readable static pattern being brought into a field of view of the optical sensor.

10. The method according to claim 9 wherein the optical sensor is prompted, during the configuration mode, to emit signals indicating desired configuration parameters by a test piece with an optically readable static pattern being brought into the field of view of the optical sensor.

11. The method according to claim 9 wherein during the configuration mode, the optical sensor is prompted to emit signals indicating desired configuration parameters by dynamically generating a predefined, optically readable pattern in the field of view of the optical sensor by a controllable light source.

12. The method according to claim 1 wherein the sensor is an optical sensor, and wherein the optical sensor is prompted to emit a signal pattern corresponding to the key signal pattern by dynamically generating a predefined, optically readable pattern in a field of view of the optical sensor by a controllable light source.

13. The method according to claim 12 wherein the optical sensor is prompted, during the configuration mode, to emit signals indicating desired configuration parameters by a test piece with an optically readable static pattern being brought into the field of view of the optical sensor.

14. The method according to claim 12 wherein during the configuration mode, the optical sensor is prompted to emit signals indicating desired configuration parameters by dynamically generating a predefined, optically readable pattern in the field of view of the optical sensor by a controllable light source.

15. The method according to claim 1 wherein the method is carried out exclusively within a predefined limited period of time following a system start of the passenger transport installation.

16. A passenger transport installation comprising:

a control and at least one sensor connected to the control for exchanging sensor signals;

wherein the control controls security related functions of the passenger transport installation taking into account configuration parameters;

wherein the at least one sensor detects operating parameters within the passenger transport installation and emits corresponding ones of the sensor signals; and wherein the passenger transport installation configures the configuration parameters by performing the method according to claim 1.

* * * * *